US011930932B2

(12) United States Patent
Freelend

(10) Patent No.: US 11,930,932 B2
(45) Date of Patent: Mar. 19, 2024

(54) ADJUSTABLE BED BASE WITH SLOTTED MOUNTING BRACKETS

(71) Applicant: L&P Property Management Company, South Gate, CA (US)

(72) Inventor: Isaac T. Freelend, Sarcoxie, MO (US)

(73) Assignee: L&P Property Management Company, South Gate, CA (US)

( * ) Notice: Subject to any disclaimer, the term of this patent is extended or adjusted under 35 U.S.C. 154(b) by 253 days.

(21) Appl. No.: 17/708,141

(22) Filed: Mar. 30, 2022

(65) Prior Publication Data

US 2023/0309702 A1 Oct. 5, 2023

(51) Int. Cl.
*A47C 20/04* (2006.01)
*A47C 19/04* (2006.01)

(52) U.S. Cl.
CPC ..... *A47C 20/041* (2013.01); *A47C 19/045* (2013.01)

(58) Field of Classification Search
CPC ..... A47C 20/041; A47C 19/045
USPC ..... 5/618
See application file for complete search history.

(56) References Cited

U.S. PATENT DOCUMENTS 1,367,621 A * 2/1921 Meves ..... A47C 17/225 5/12.2
5,271,109 A * 12/1993 Markel ..... A47C 17/1756 5/47
6,249,926 B1 * 6/2001 Wulff ..... A47L 11/4077 15/320
8,960,971 B1 * 2/2015 Newton ..... F21S 8/036 362/371
9,049,942 B2 * 6/2015 Huang ..... A61G 7/018
9,125,776 B1 * 9/2015 Shih ..... A61G 7/018
9,918,556 B2 * 3/2018 Rawls-Meehan .... A47C 27/082
9,944,208 B2 * 4/2018 Cheng ..... A61G 5/128
2007/0157385 A1 * 7/2007 Lemire ..... A61G 7/0524 5/618
2008/0289101 A1 * 11/2008 Patterson ..... A61G 7/1032 5/81.1 HS
2009/0140114 A1 * 6/2009 Blackburn ..... A47B 21/0314 248/282.1
2010/0007180 A1 * 1/2010 Ovre ..... A61G 5/127 297/354.1
2011/0094032 A1 * 4/2011 Shih ..... A47C 20/041 5/616
2012/0096645 A1 * 4/2012 Shih ..... A47C 20/041 5/616
2012/0240337 A1 * 9/2012 Shih ..... A61G 7/015 5/616
2014/0093861 A1 * 4/2014 Scolari ..... G09B 9/04 434/373

(Continued)

FOREIGN PATENT DOCUMENTS

EP 1219204 A2 * 7/2002 ..... A47B 46/005

*Primary Examiner* — Justin C Mikowski
*Assistant Examiner* — Luke Hall
(74) *Attorney, Agent, or Firm* — Wood Herron & Evans LLP

(57) ABSTRACT

An adjustable bed base has a stationary frame. An articulated deck is attached to the frame. The deck may be flat or fully articulated depending upon the position of linear actuators which are secured to the frame at one end and to a brace at the other end. The deck may be further inclined due to slotted mounting brackets, thereby allowing access to components below the deck members.

20 Claims, 6 Drawing Sheets

(56) References Cited

U.S. PATENT DOCUMENTS

| | | | | |
|---|---|---|---|---|
| 2014/0250600 | A1* | 9/2014 | Mccarty | A47C 20/041 5/617 |
| 2016/0051057 | A1* | 2/2016 | Murphy | A47C 17/2073 5/29 |
| 2016/0331609 | A1* | 11/2016 | Cheng | A61G 5/128 |
| 2017/0087039 | A1* | 3/2017 | Shih | A61G 7/018 |
| 2019/0021511 | A1* | 1/2019 | Shih | A47C 20/041 |
| 2019/0125089 | A1* | 5/2019 | Aramli | A47C 19/021 |

* cited by examiner

ADJUSTABLE BED BASE WITH SLOTTED MOUNTING BRACKETS

FIELD OF THE INVENTION

This invention relates an adjustable bed base having slotted mounting brackets to allow access below the deck of the adjustable bed base.

BACKGROUND OF THE INVENTION

Conventional adjustable bed bases often have a stationary frame supported by leg assemblies. Such adjustable bed bases typically include an articulated deck supported by the stationary frame. The articulated deck supports a mattress. The articulated deck usually comprises multiple deck members hinged together. One of the deck members is commonly fixedly secured to the stationary frame. A head deck member is typically hinged to the seat deck member. A first motorized actuator inclines the front end of the head deck member so a user may sit up and read or watch television in an inclined position.

A leg deck member is commonly hinged to the rear end of the seat deck member and a foot deck member hinged to the leg deck member. A second motorized actuator serves to incline the leg and foot deck members around a person's knees for comfort.

One drawback to such common adjustable bed bases is that conventional adjustable bed bases have a limited range of angular articulation of the deck boards which limits access to the electronic and mechanical components located underneath the deck. To perform service or replace one or more of these components, the adjustable bed base must be turned over or partially disassembled.

Another drawback to known adjustable bed bases is that a user may damage one or more linear actuators by trying to manipulate one or more members of the articulated deck beyond the deck member's intended range of travel.

In view of the above, there is a need for an adjustable bed base having a design which protects one or more linear actuators of the adjustable bed base. There is further a need for an adjustable bed base which provides improved access to electronic and mechanical components located underneath the deck.

It is therefore an objective of this invention to provide an adjustable bed base which protects one or more linear actuators of the adjustable bed base.

It is further an objective of this invention to provide an adjustable bed base which provides improved access to electronic and mechanical components located underneath the deck.

SUMMARY OF THE INVENTION

According to one aspect of the invention, an adjustable bed base comprises a generally rectangular stationary frame having opposed side members, a head member, a foot member and a cross member. The head member, foot member and cross member each extend between the opposed side members. The stationary frame is supported by legs having adjustable heights.

A first slotted mounting bracket is secured to the cross member of the stationary frame. A second slotted mounting bracket is secured to the foot member of the stationary frame.

An articulated deck is secured to the generally rectangular stationary frame. The articulated deck comprises multiple deck pieces hinged together. In one embodiment, the articulated deck comprises four deck pieces: a head deck board, a seat deck board, a leg deck board and a foot deck board hinged together. The seat deck board is secured to the stationary frame and does not move during the operation of the adjustable bed base. The deck boards may be made of wood, plastic or any known material.

A head brace is secured to the deck board. A leg brace is secured to the leg deck board. In one embodiment, the head and leg braces each comprise three metal pieces and are generally U-shaped. A head mounting bracket is secured to the head brace and a leg mounting bracket is secured to the leg brace. The head and leg mounting brackets do not have slots like the slotted mounting brackets.

Linear actuators extend between mounting brackets and function to move the head, leg and foot deck boards while the seat deck board remains stationary. The linear actuators are typically motorized and controlled via a remote control but need not be motorized. A front linear actuator raises and lowers the head deck board between a flat position and a fully inclined position. The front linear actuator has a front end pivotally secured to the head mounting bracket and a rear end having pins movable inside slots of the first or front slotted mounting bracket. The front linear actuator moves between a retracted position and a fully extended position. When the front linear actuator is in its fully extended position, the head deck board is in it fully inclined position. However, the head deck board may be further inclined to an access position, by an operator moving the front end of the head deck board rearwardly. This movement causes the pins of the front linear actuator to move along the slots in the first slotted mounting bracket, thereby providing additional movement of the head deck board. This further movement allows access to the electronic and mechanical components or any stored items located underneath the deck.

A rear linear actuator moves the leg and foot deck board between a flat position and a fully inclined position. The rear linear actuator has a front end pivotally secured to the leg mounting bracket and a rear end having pins movable inside slots of the second slotted mounting bracket. The rear linear actuator moves between a retracted position and a fully extended position. When the rear linear actuator is in its fully extended position, the leg and foot deck boards is in their fully inclined positions. However, the leg and foot deck boards may be further inclined to access positions, by an operator, thereby moving the rear end of the foot deck board forwardly. This movement causes the pins of the rear linear actuator to move along the slots in the second slotted mounting bracket, thereby providing additional movement of the foot deck board in a forward direction. This further movement allows access to the electronic and mechanical components located underneath the deck.

The slots in the slotted mounting brackets enable additional movement of the deck boards beyond the maximum travel of the linear actuators to provide access underneath the articulated deck.

The accompanying drawings, which are incorporated in and constitute a part of this specification, illustrate embodiments of the invention and, together with the summary of the invention given above, and the detailed description of the drawings given below, explain the principles of the present invention.

DETAILED DESCRIPTION OF THE INVENTION

Figure 1:
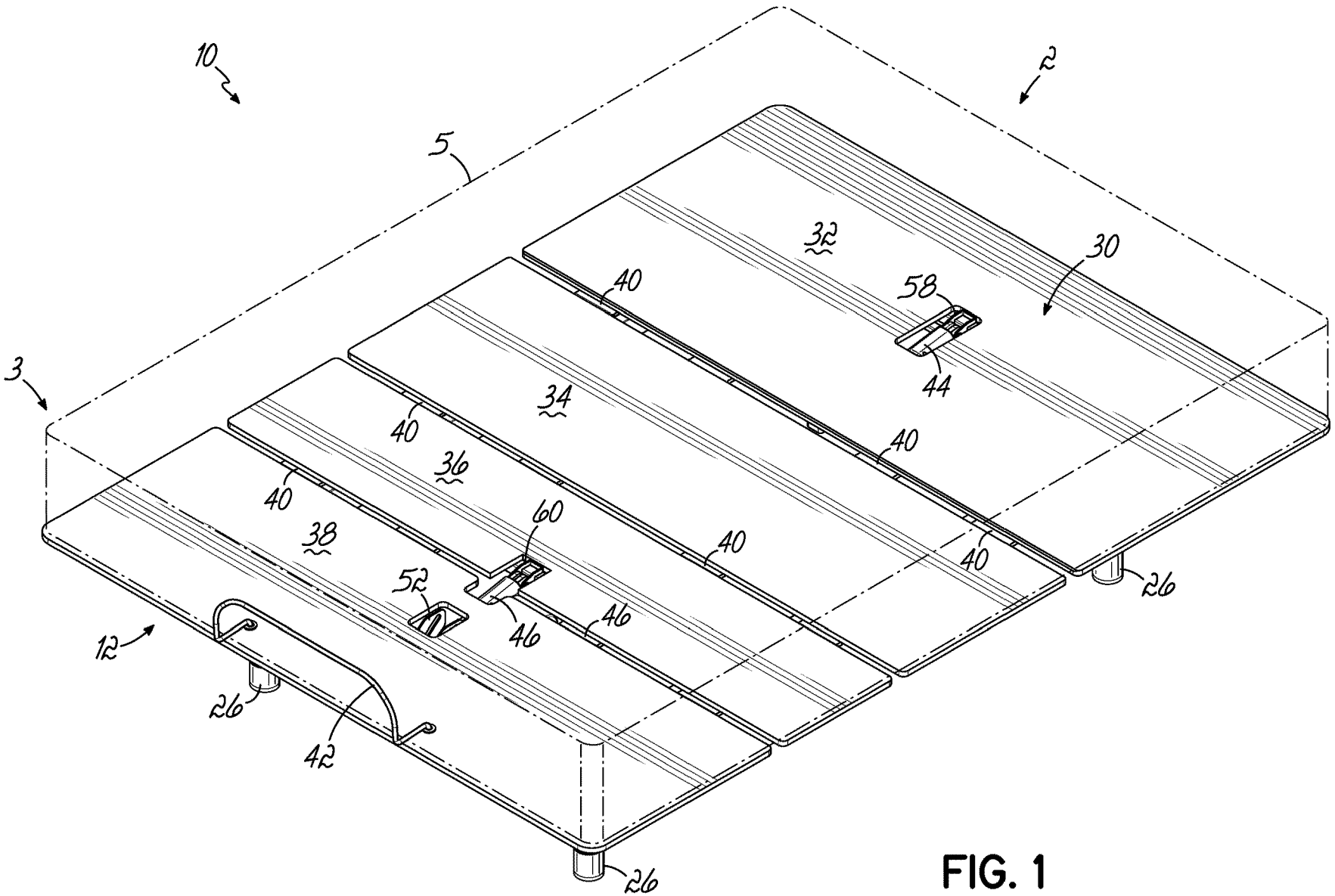
FIG. 1 is a top perspective view of an adjustable bed base.

Referring to FIG. 1, an adjustable bed 10 has a head end 2 and a foot end 3. The adjustable bed 10 includes an adjustable bed base 12 for supporting a mattress 5. The adjustable bed base 12 of the present invention may be used with any type of mattress. The mattress is not intended to be limited by the drawings.

Figure 2:
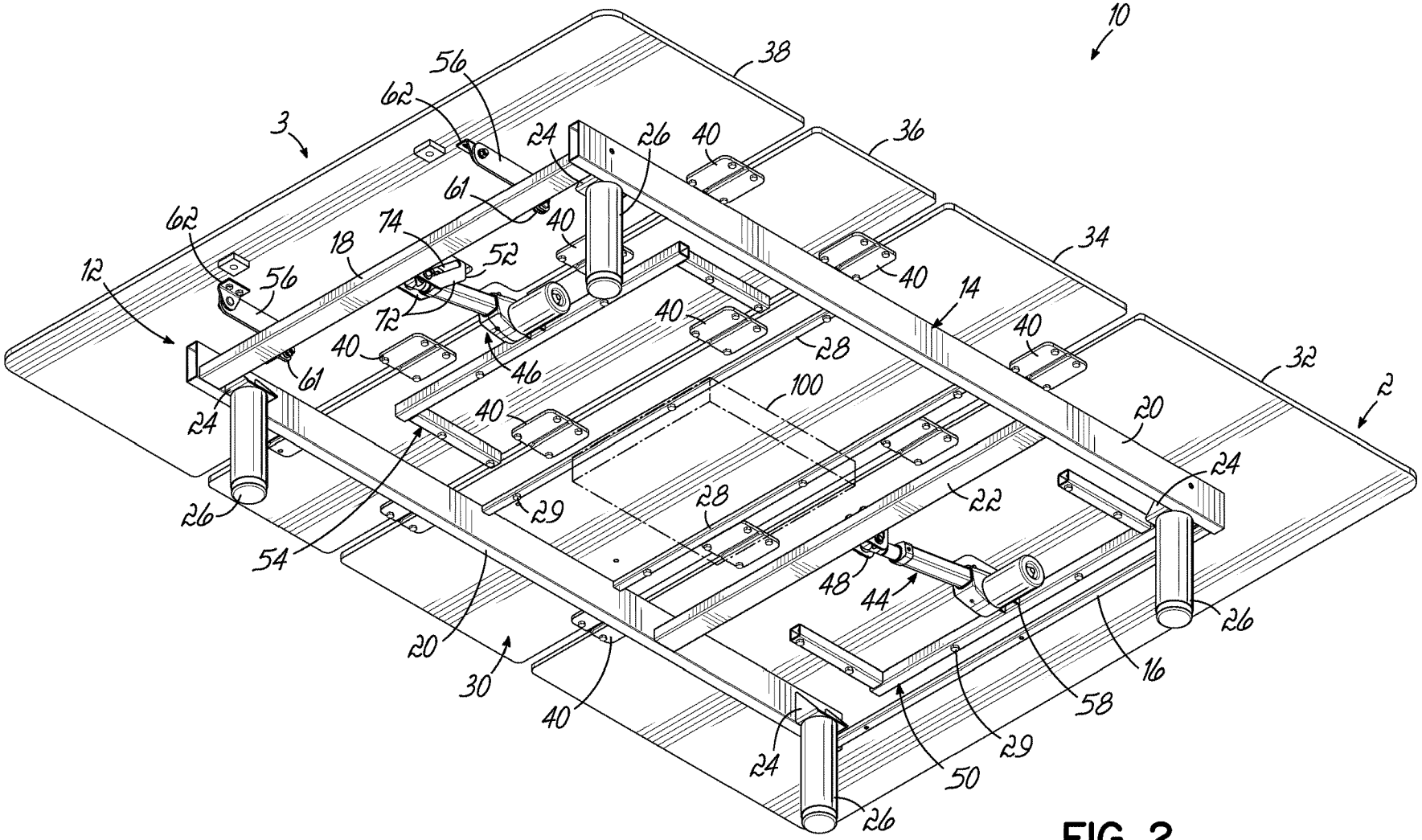
FIG. 2 is a bottom perspective view of the adjustable bed base of FIG. 1 showing the deck in a flat condition.

As best shown in FIG. 2, the adjustable bed base 12 comprises a generally rectangular metal frame 14 supported by four leg assemblies 18. Although one type of generally rectangular metal frame 14 is illustrated being part of the adjustable bed base 12, any other type of generally rectangular frame may be supported by any number of leg assemblies constructed in accordance with the present invention. The frame is not intended to be limited by the drawings.

As best shown in FIG. 2, the generally rectangular metal frame 14 comprises a head member 16, a foot member 18 and two side members 20, the head and foot members 16, 18 extending between the side members 20, respectively. As best shown in FIG. 2, the generally rectangular metal frame 14 further comprises a hollow cross member 22 extending between the side members 20 and two support members 28 extending between the side members 20. Although each of the frame members 16, 18, 20 and 22 is illustrated as having a hollow interior, one or more frame members may have a filled interior or partially filled interior.

As best shown in FIG. 2, the generally rectangular metal frame 14 further comprises leg brackets 24 welded or otherwise secured to the side members 20 of the generally rectangular metal frame 14. A leg 26 adjustable in height is secured to each of the leg brackets 24. Each leg 26 may or may not be adjustable in height. The drawings are not intended to limit the shape or configuration of legs.

As best shown in FIGS. 1 and 2, the adjustable bed base 12 further comprises an articulated deck 30 comprising a head deck board 32 hinged to a seat deck board 34 with hinges 40. As best shown in FIGS. 2 and 3, the seat deck board 34 is secured to support members 28 of the generally rectangular frame 16 with fasteners 29 and does not move when the deck 30 is articulated. A leg deck board 36 is hinged to the seat deck board 36 with hinges 40. Lastly, a foot deck board 38 is hinged to the leg deck board 36 with hinges 40.

Figure 3A:
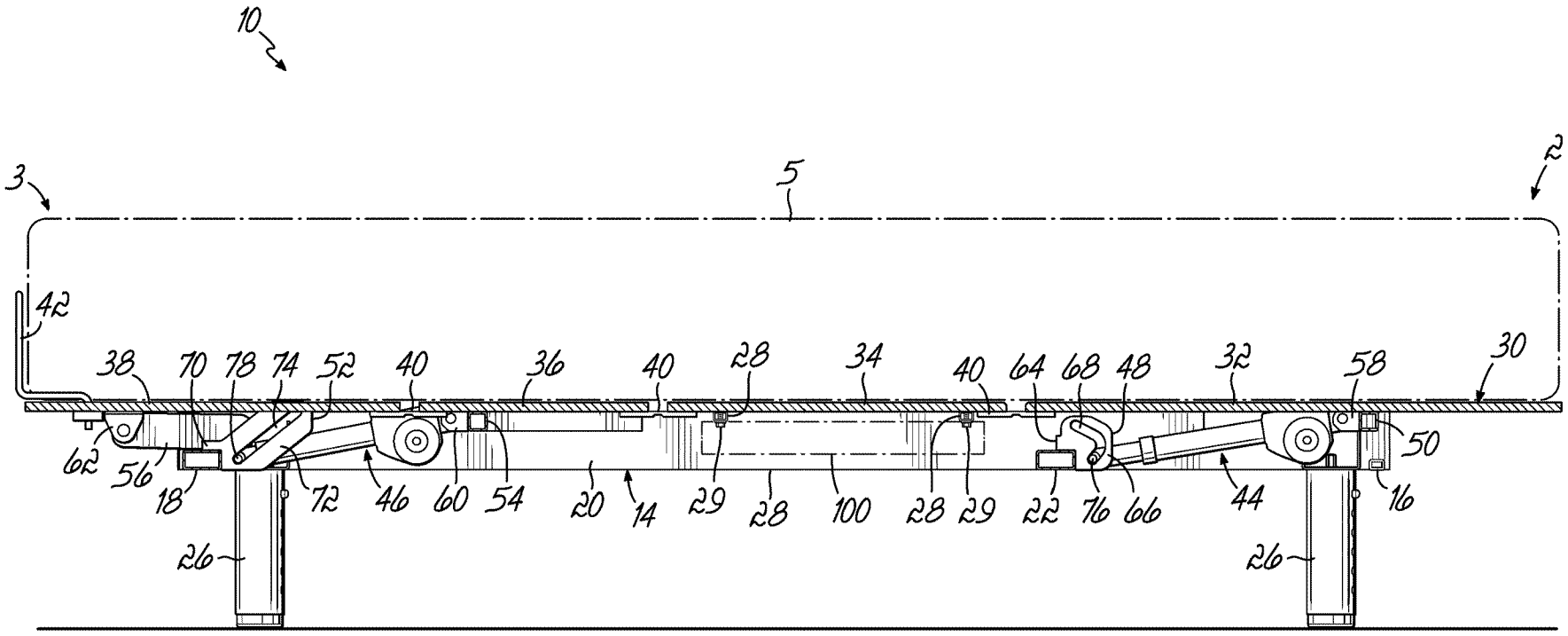
FIG. 3A is a longitudinal cross-sectional view of the adjustable bed base of FIG. 2.
Figure 3B:
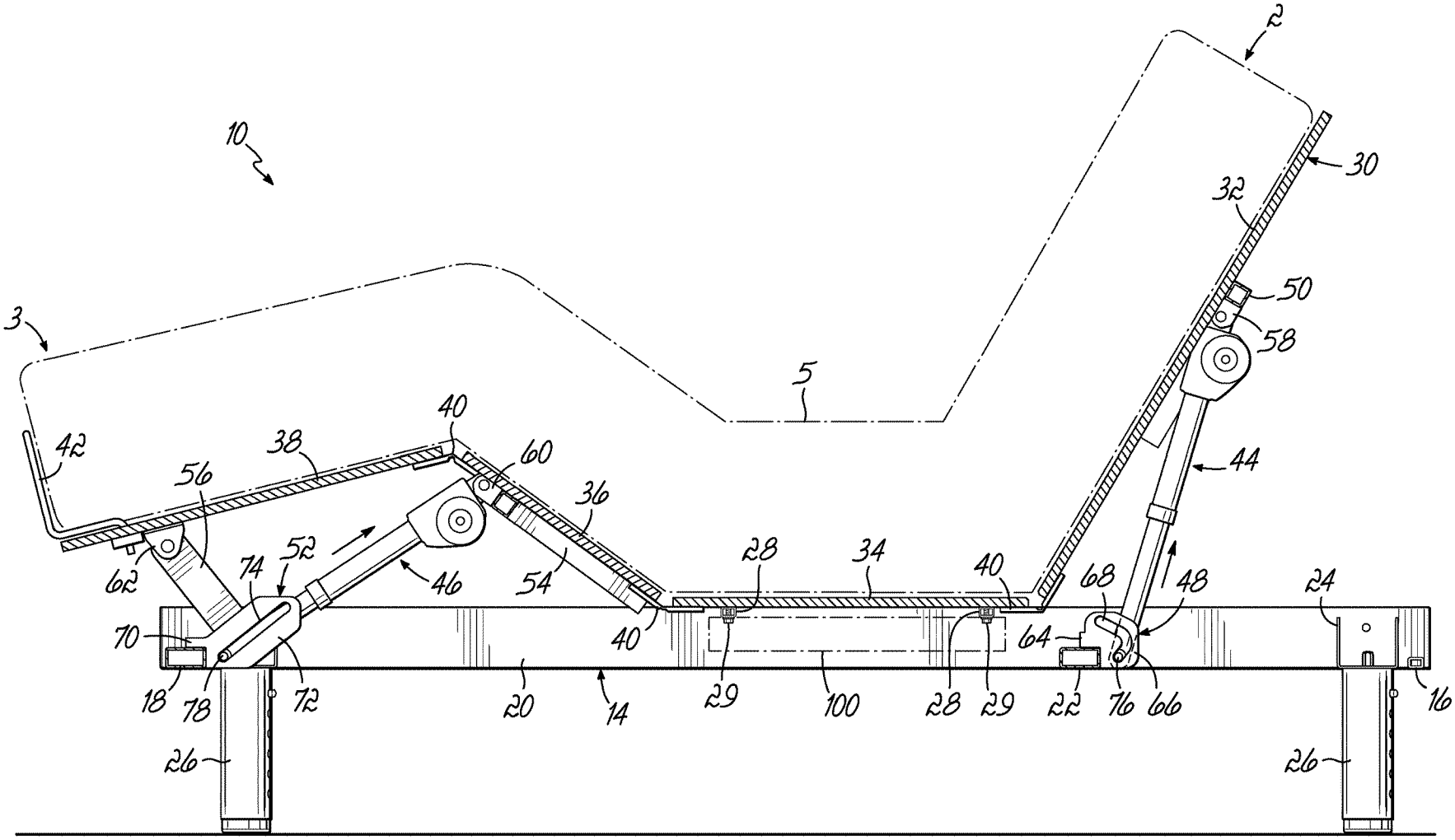
FIG. 3B is a longitudinal cross-sectional view of the adjustable bed base of FIGS. 1 and 2 showing the deck members fully inclined.

As best shown in FIGS. 1 and 3B, a stop 42 is secured to the foot deck board 38 of the deck 30 and functions to prevent movement of the mattress 5 relative to the adjustable bed base 12 when the deck 30 is articulated.

As best shown in FIG. 2, the adjustable bed base 12 further comprises two motorized linear actuators 44, 46. The first or front motorized linear actuator 44 located proximate the head end 2 of the adjustable bed base 12 extends between a first or front slotted mounting bracket 48 secured to the hollow cross member 22 of the stationary frame 14 and a head mounting bracket 58 secured to a U-shaped metal brace 50 secured to the underside of the head deck board 32. The U-shaped metal brace 50 is shown comprising three members. However, it may be any number of members of any desired material. The first motorized linear actuator 44 is used to incline the head deck board 32.

As best shown in FIG. 2, the second or rear motorized linear actuator 46 extends between a second or rear slotted mounting bracket 52 secured to the hollow end member 18 of the stationary frame 16 and a leg mounting bracket 60 secured to a U-shaped brace 54 secured to the underside of the foot deck board 38. The U-shaped metal brace 54 is shown comprising three members. However, it may be any number of members of any desired material. The second motorized linear actuator 46 is used to incline the leg deck board 36 and foot deck board 38.

As best shown in FIG. 2, the adjustable bed base 12 further comprises two foot links 56. Each foot link 56 is secured by bracket 61 to the hollow foot member 18 of the stationary frame 14 at one end and secured to a mounting bracket 62 at the other end. The mounting bracket 62 is secured to the foot deck board 38.

Figure 3C:
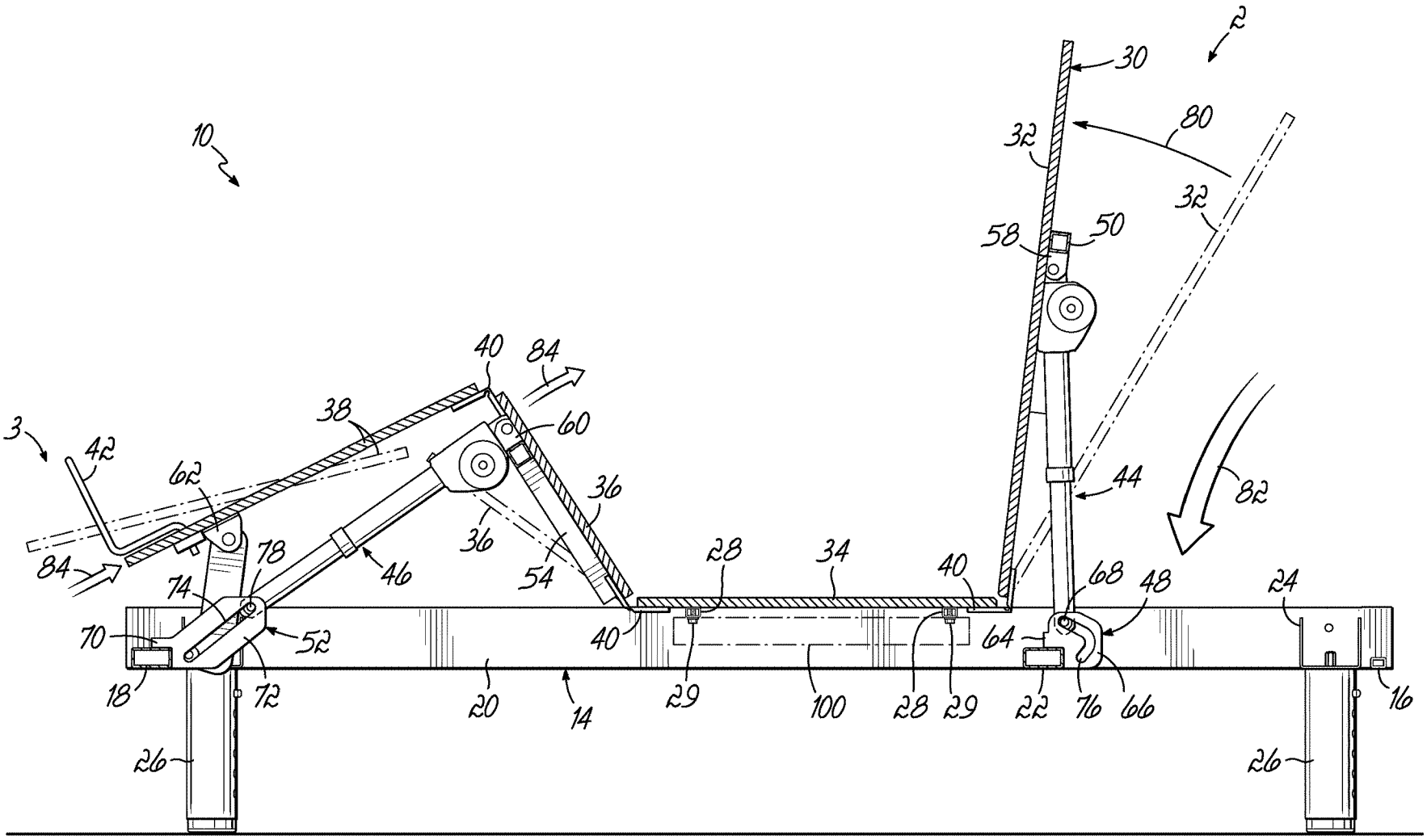
FIG. 3C is longitudinal cross-sectional view of the adjustable bed base of FIGS. 1 and 2 showing the deck members in their access positions.
Figure 4:
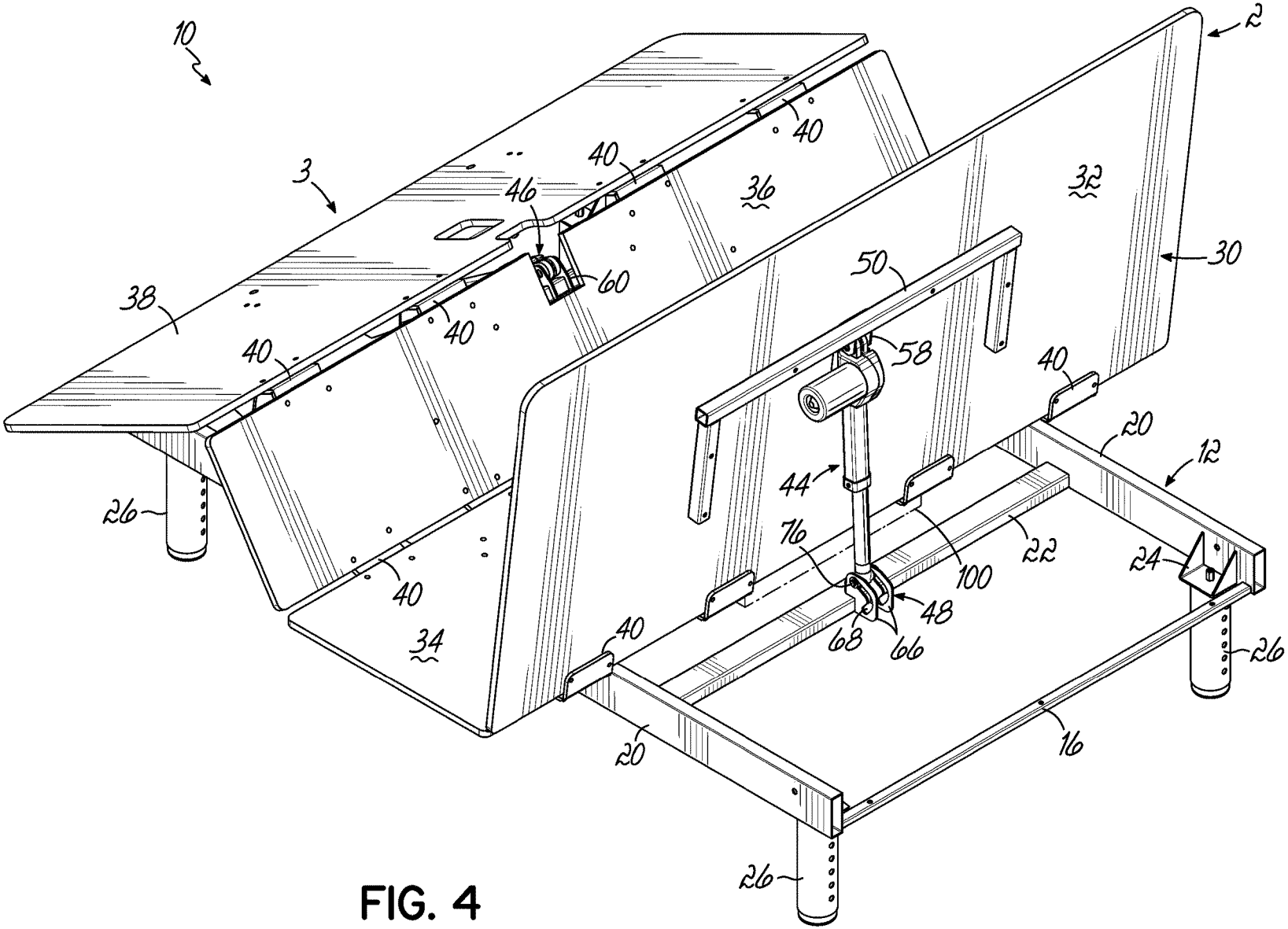
FIG. 4 is a perspective view of the adjustable bed base of FIG. 3C, the deck members being in their access positions.

As best shown in FIGS. 3C and 4, the front slotted mounting bracket 48 is a unitary metal member having a general U-shape including a back portion 64 welded or otherwise secured to the hollow cross member 22 and two walls 66 extending outwardly from back portion 64. As best shown in FIG. 4, each of the walls 66 has an arcuate or curved slot 68.

As best shown in FIG. 2, the rear slotted mounting bracket 52 is a unitary metal member having a general U-shape including a back portion 70 welded or otherwise secured to the hollow foot member 18 and two walls 72 extending outwardly from back portion 70. As best shown in FIG. 4, each of the walls 72 has a straight or linear slot 74.

As best shown in FIG. 2, the adjustable bed base 12 further comprises a control box 100 shown in dashed lines secured to the support members 28 of the stationary frame 14. The control box 100 is shown without wires to the front and rear linear actuators 44, 46. A remote control may communicate with the control box 100 to operate the front and rear linear actuators 44, 46 as desired by an operator.

The operation of the present invention is illustrated in FIGS. 3A-3C. In FIG. 3A, the front and rear linear actuators 44, 46 are in their retracted positions and the deck 30 is flat. The deck boards 32, 34, 36 and 38 are generally planar. Pins 76 extending outwardly from the rear end of the front linear actuator 44 are located at the bottom of the curved slots 68 of the front slotted mounting bracket 48. Similarly, pins 78 extending outwardly from the rear end of the rear linear actuator 46 are located at the bottom of the straight slots 74 of the rear slotted mounting bracket 52.

In FIG. 3B, the front and rear linear actuators 44, 46 are in their fully extended positions and the deck 30 is fully inclined. The deck boards 32, 36 and 38 are inclined while the seat deck board 34 remains in its original stationary position. The pins 76 extending outwardly from the rear end of the front linear actuator 44 are in the same locations they were in FIG. 3A, at the bottom of the curved slots 68 of the front slotted mounting bracket 48. Similarly, pins 78 extending outwardly from the rear end of the rear linear actuator 46 are located are in the same locations they were in FIG. 3A, at the bottom of the straight slots 74 of the rear slotted mounting bracket 52. In other words, the full extensions of the front and rear linear actuators 44, 46 do not change the locations of the pins 76, 78 in the front and rear slotted mounting brackets 48, 52, respectively.

In FIG. 3C, an operator may manually move the head deck board 32 forward in the direction of arrow 80 from its position shown in dashed lines in FIG. 3C to its access position shown in solid lines in FIG. 3C due the front slotted mounting bracket 48. Although the front linear actuator 44 is in its fully extended position and may not be further extended, the pins 76 move upwardly along the curved path of the slots 68, thereby enabling the head deck board 32 to move to its access position shown in solid lines in FIG. 3C. This addition movement of the head deck board 32 enables a person to reach downwardly in the direction of arrow 82 to access mechanical and electrical components such as the control box 100 shown in dashed lines in FIG. 3C.

Similarly, an operator may manually move the leg deck board 36 forward in the direction of arrow 84 from its fully inclined position shown in FIG. 3B (and in dashed lines in FIG. 3C) to its access position shown in solid lines in FIG. 3C due the rear slotted mounting bracket 52. Such movement of the leg deck board 36 moves the foot deck board 38 from its fully inclined position shown in FIG. 3B (and in dashed lines in FIG. 3C) to its access position shown in solid lines in FIG. 3C. Although the rear linear actuator 46 is in its fully extended position and may not be further extended, the pins 78 move upwardly along the straight path of the straight slots 74, thereby enabling the leg and foot deck boards 36, 38, respectively, to move to their access positions, shown in solid lines in FIG. 3C. This addition movement of the leg and foot deck boards 36, 38 makes it easier for a person to reach downwardly underneath the foot deck board 38 to access mechanical and electrical components such as the control box 100 under the extended deck.

The configuration of the slots 68 in the first slotted mounting bracket 48 and pins 76 of the front linear actuator 44 provide additional movement of the head deck board 32 beyond its position provided solely by full extension of the front linear actuator 44 and thereby provide improved access to mechanical and electrical components such as the control box 100 under the deck or items stored underneath the deck.

Similarly, the configuration of the slots 74 in the second slotted mounting bracket 52 and pins 78 of the rear linear actuator 46 provide additional movement of the leg and foot deck boards 36, 38 beyond their positions provided solely by full extension of the rear linear actuator 46 and thereby provide improved access to mechanical and electrical components such as the control box 100 under the deck or items stored underneath the deck.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. An adjustable bed base comprising:

a generally rectangular stationary frame having opposed side members, a head member; a foot member and a cross member extending between the opposed side members;

a first slotted mounting bracket secured to the cross member of the stationary frame;

a second slotted mounting bracket secured to the foot member of the stationary frame;

an articulated deck comprising a head deck board, a seat deck board, a leg deck board and a foot deck board hinged together, the seat deck board being secured to the stationary frame;

a head brace secured to the head deck board;

a head mounting bracket secured to the head brace;

a leg brace secured to the leg deck board;

a leg mounting bracket secured to the leg brace;

a front linear actuator for raising and lowering the head deck board of the articulated deck, the front linear actuator having a front end pivotally secured to the head mounting bracket and a rear end having pins movable inside slots of the first slotted mounting bracket;

a rear linear actuator for raising and lowering the foot and leg deck boards of the articulated deck, the rear linear actuator having a front end pivotally secured to the leg mounting bracket and a second end having pins movable inside slots of the second slotted mounting bracket.

2. The adjustable bed base of claim 1, further comprising legs for supporting the stationary frame, the legs having adjustable heights.

3. The adjustable bed base of claim 1, wherein the head and leg braces are generally U-shaped.

4. The adjustable bed base of claim 1, wherein the linear actuators are motorized.

5. The adjustable bed base of claim 1, wherein the slots in the slotted mounting brackets enable additional movement of the deck boards beyond the maximum travel of the linear actuators to provide access underneath the articulated deck.

6. The adjustable bed base of claim 1, wherein the first slotted bracket has two walls, each of the walls having an arcuate slot extending through the wall.

7. The adjustable bed base of claim 1, wherein the second slotted bracket has two walls, each of the walls having a linear slot extending through the wall.

8. An adjustable bed base comprising:

a stationary frame having opposed side members, a head member, a foot member, a cross member extending between the opposed side members and two support members extending between the opposed side members;

a first slotted mounting bracket secured to the cross member of the stationary frame;

a second slotted mounting bracket secured to the foot member of the stationary frame;

an articulated deck comprising a head deck board, a seat deck board, a leg deck board and a foot deck board hinged together, the seat deck board being secured to the stationary frame;

a head brace secured to the head deck board;

a leg brace secured to the leg deck board;

a head mounting bracket secured to the head brace;

a leg mounting bracket secured to the leg brace;

a front linear actuator for raising and lowering the head deck board of the articulated deck, the front linear actuator having a front end pivotally secured to the head mounting bracket and a rear end having pins movable inside slots of the first slotted mounting bracket;

a rear linear actuator for raising and lowering the foot and leg deck boards of the articulated deck, the rear linear actuator having a first end pivotally secured to the leg mounting bracket and a second end having pins movable inside slots of the second slotted mounting bracket, wherein the pins of the front linear actuator move inside the slots of the first slotted mounting bracket to further incline the head deck board beyond its inclined position in which the front linear actuator is fully extended.

9. The adjustable bed base of claim 8, further comprising legs secured to the stationary frame for supporting the stationary frame.

10. The adjustable bed base of claim 9, wherein the pins of the rear linear actuator move inside the slots of the second slotted mounting bracket to further incline the leg and foot deck boards beyond their inclined positions corresponding to when the rear linear actuator is in its full extended position.

11. The adjustable bed base of claim 8, wherein the head and leg braces are generally U-shaped.

12. The adjustable bed base of claim 8, wherein the linear actuators are motorized.

13. The adjustable bed base of claim 8, wherein the head and leg mounting brackets lack slots.

14. The adjustable bed base of claim 8, wherein the first slotted bracket has two walls, each of the walls having an arcuate slot extending through the wall.

15. The adjustable bed base of claim 8, wherein the second slotted bracket has two walls, each of the walls having a linear slot extending through the wall.

16. An adjustable bed base comprising:

a stationary frame having opposed side members, a head member, a foot member and a cross member extending between the opposed side members;

a first slotted mounting bracket secured to the cross member of the stationary frame;

a second slotted mounting bracket secured to the foot member of the stationary frame;

an articulated deck comprising a head deck board, a seat deck board, a leg deck board and a foot deck board hinged together, the seat deck board being secured to the stationary frame;

a head brace secured to the head deck board;

a leg brace secured to the leg deck board;

a head mounting bracket secured to the head brace;

a leg mounting bracket secured to the leg brace;

a front linear actuator for raising and lowering the head deck board of the articulated deck, the front linear actuator having a front end pivotally secured to the head mounting bracket and a rear end having pins movable inside slots of the first slotted mounting bracket;

a rear linear actuator for raising and lowering the foot and leg deck boards of the articulated deck, the rear linear actuator having a first end pivotally secured to the leg mounting bracket and a second end having pins movable inside slots of the second slotted mounting bracket, wherein the pins of the front and rear linear actuator move inside the slots of the slotted mounting brackets to further incline the head, leg and foot deck board beyond their respective positions when the front and rear linear actuators are fully extended.

17. The adjustable bed base of claim 16, wherein the first slotted bracket has two walls, each of the walls having an arcuate slot extending through the wall.

18. The adjustable bed base of claim 16, wherein the second slotted bracket has two walls, each of the walls having a linear slot extending through the wall.

19. The adjustable bed base of claim 16, further comprising legs secured to the stationary frame for supporting the stationary frame.

20. The adjustable bed base of claim 16, wherein the head and leg mounting brackets lack slots.

* * * * *